US006615437B1

(12) United States Patent
Chow

(10) Patent No.: US 6,615,437 B1
(45) Date of Patent: Sep. 9, 2003

(54) GEAR-ENABLED WRINGING DEVICE

(75) Inventor: Sik Cheung Chow, Dublin, OH (US)

(73) Assignee: May's Industries, Ltd., Dublin, OH (US)

( * ) Notice: Subject to any disclaimer, the term of this patent is extended or adjusted under 35 U.S.C. 154(b) by 0 days.

(21) Appl. No.: 09/548,221

(22) Filed: Apr. 12, 2000

(51) Int. Cl.[7] ..... A47L 13/142
(52) U.S. Cl. ..... 15/120.1; 15/120.2
(58) Field of Search ..... 15/120.1, 120.2

(56) References Cited

U.S. PATENT DOCUMENTS 684,115 A * 10/1901 Shaw
768,776 A * 8/1904 Shaw
3,616,483 A 11/1971 Mantelet
4,130,910 A 12/1978 Raven
5,566,417 A 10/1996 Hsieh
5,850,658 A 12/1998 Specht

* cited by examiner

*Primary Examiner*—Randall E. Chin
(74) *Attorney, Agent, or Firm*—Standley & Gilcrest LLP

(57) ABSTRACT

A gear-driven cleaning device having two gear components attached to the elongate handle. The first gear component providing torque for driving the second gear component which drives a wringing component. The cleaning device also having a pawl and ratchet arrangement for preventing the handle from rotating in a predetermined direction during the wringing process.

17 Claims, 7 Drawing Sheets

GEAR-ENABLED WRINGING DEVICE

BACKGROUND AND SUMMARY OF THE INVENTION

The present invention relates to a gear-enabled wringable device. More particularly, to a mop having gear-driven means to wring liquid from the mop, or other cleaning attachment connected to the device. The new and unique mop of the present invention incorporates a series of gears to facilitate twisting of the mop, or other attached device, into a tightly wound position. Furthermore, in a preferred embodiment, the present invention incorporates a unique ratchet and pawl configuration to prevent the loosening of the mop, or other attached device, during the wringing process.

Known string mops have incorporated mechanisms for wringing liquid out of mop strings by twisting the string around the mop handle. For example, U.S. Pat. No. 5,850,658 to Specht describes such a mop. These known mops require considerable effort during manual twisting of the mop strings around the handle, especially where the mop strings are long and thick. Accordingly, many older and weaker users find it difficult to wring such mops, and such workers cannot wring the mops to a tightly wound condition required to expel most of the absorbed liquid.

The present invention provides a wringing device driven by a series of gears that allows easy twisting of the mop strands around the handle. The present invention is preferably comprised of:

an elongate handle member;

a first gear component connected to the handle, wherein rotation of the handle drives the first gear component;

a second gear component. operationally linked to the first gear component so that the first gear component drives the second gear component (and the handle);

a movable component, the movable component adapted to move along a length of the handle from a mopping position to a wringing position, said movable component operationally linked to the second gear component so that the second gear component drives the movable component in a rotational movement about the handle when the handle is rotated so as to wring the attached cleaning attachment.

The device may also include a connector mechanically linked between the moveable component and the second gear component, the connector driven by the second gear component so as to rotate around the handle. The connector is adapted to attach to the moveable component when in the wringing position, and wherein the rotational movement of the connector, or a portion thereof, drives the moveable component in a predetermined rotational direction around the handle so as to wring the cleaning attachment. The connector is preferably comprised of:

a first section rotatably moveable around the handle and driven by the second gear component;

a second section operationally linked to the first section and rotatably moveable around said handle, and wherein the second section is adapted for moving longitudinally along the handle when driven by the rotating first section, wherein a distal end of the second section is connected to the moveable component so as to rotatably drive the moveable component during the wringing process; and a spring operationally connected to the second section of the connector, wherein the spring is compressed when the second section of the connector moves toward the cleaning attachment during the wringing process. The moveable component rotates in one predetermined direction and the handle rotates in the opposite direction during the wringing process (see FIG. 7).

Furthermore, the present invention has a unique ratchet and pawl configuration that allows the mop to be wrung in a unidirectional rotation. When twisting the handle during the wringing process, the user's hands can only rotate a limited number of degrees before the user has to reposition his or her hands for another twist. Without the pawl and ratchet configuration, the wound mop strings would tend to unwind as the user releases the handle since the mop strands will no longer be under a force to stay in the wound condition. The pawl and ratchet configuration prevents the wound mop strings to unwind by allowing rotation of the mop, or mop shaft, in only one direction during the wringing process. Accordingly, the user can release the handle during the wringing process without worrying about the release of the mop strands from the wound position.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts, and in which.

DETAIL DESCRIPTION OF PREFERRED EMBODIMENT(S)

The preferred system herein described is not intended to be exhaustive or to limit the invention to the precise forms disclosed. They are chosen and described to explain the principles of the invention and the application of the method to practical uses so that others skilled in the art may practice the invention.

Figure 1A:
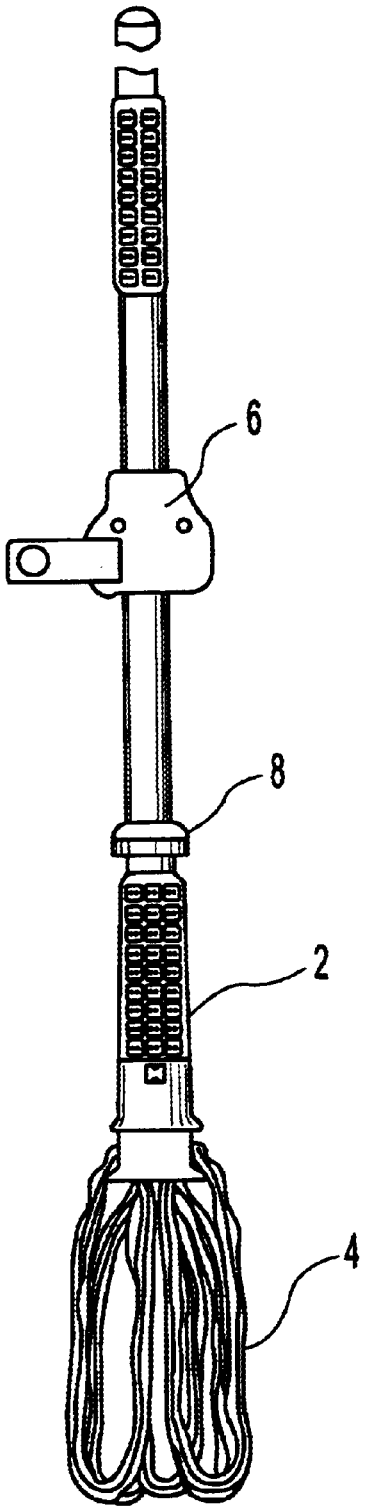
Fig. 1A (Prior Art)
FIGS. 1A–1B illustrate a known wringing-type mop.
Figure 1B:
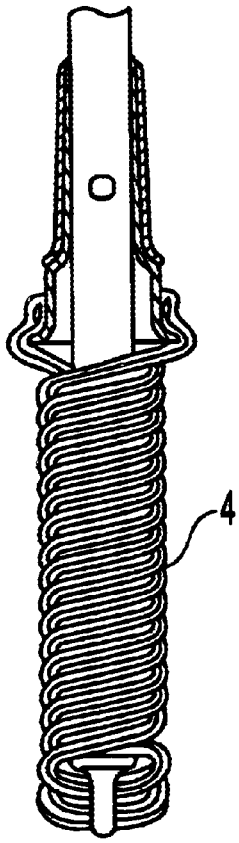
Fig. 1B (Prior Art)

FIGS. 1A–1B illustrate a known wringing-type mop. FIG. 1A illustrates the mop in a mopping position where the operating member 2 is in the down position and where the mop strands 4 are hanging loosely at the end of the mop. FIG. 1B illustrates the mop in a wringing position where the operating member 2 is in the up position. The operating member 2 moves longitudinally up the mop and is connected to the latch housing 6 via the mating piece 8. In the wringing position, the mop strands 4 are pulled along the length of the mop handle and are wrung around the handle as the operating member 2 is manually rotated around the handle. The known mop of FIGS. 1A and 1B must be manually wrung and has the shortcomings addressed in the background discussion.

Figure 2:
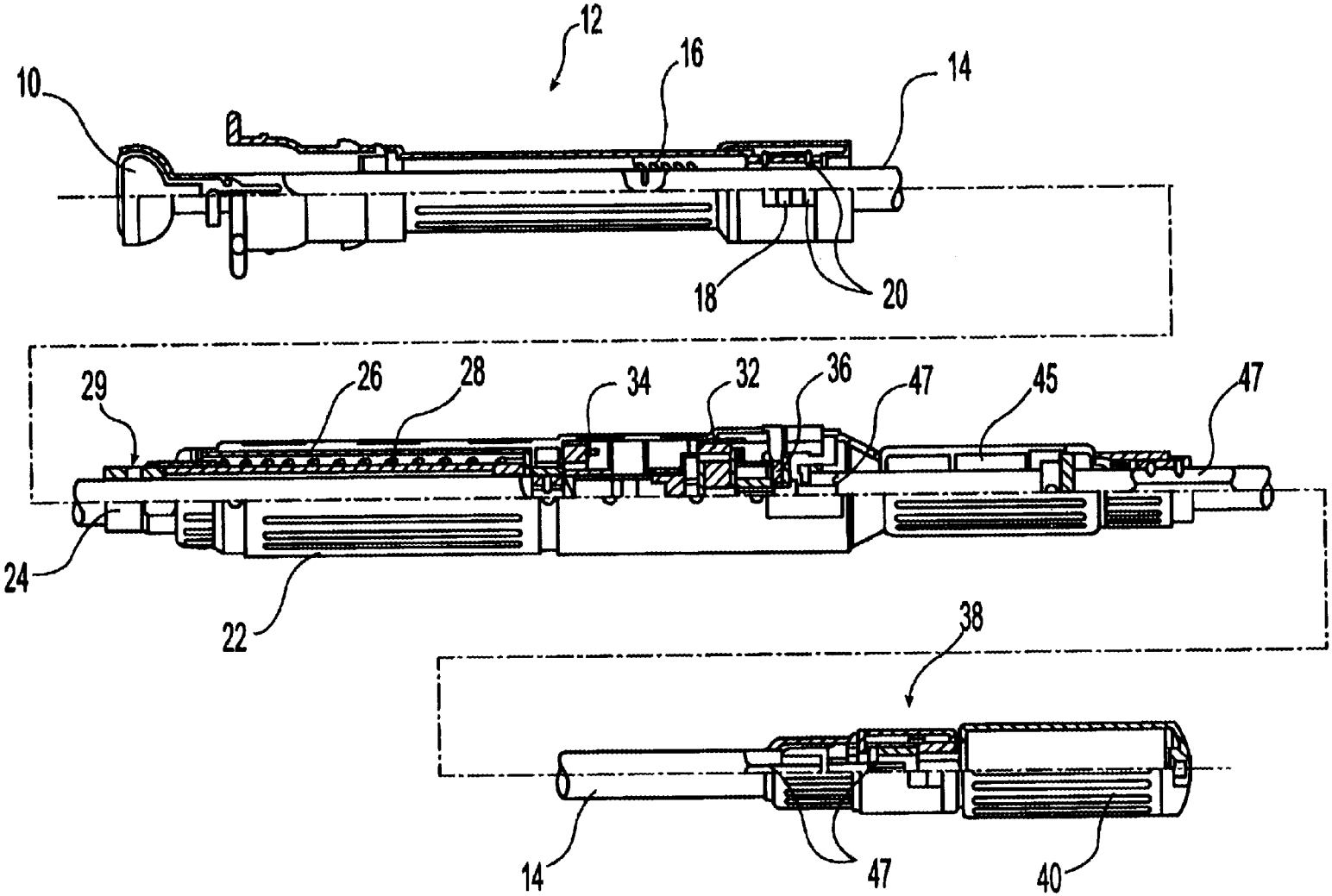
FIG. 2 illustrates a cross-sectional view of the gear-driven mop of the present invention.

FIG. 2 illustrates a cross-sectional view of one embodiment of the gear-driven mop of the present invention. In one embodiment the mop of the present invention is comprised of:

a mop end piece 10;

a moveable component 12;

an elongated handle 14;

a stabilizer kit 16;

a stabilizer lock and release mechanism 18;

a connector lock and release mechanism 20;

a connector portion 22, the connector 22 is comprised of an inner tube 24, an outer tube 26, a spring 28, and an attachment mechanism 29;

a first gear 32;

a second gear 34;

a ratchet device 36;

another attachment mechanism 38; and a handle grip 40.

The moveable component 12 moves along the length of the handle 14 from a mopping position (moveable component 12 near the end piece 10) to a wringing position (moveable component 12 attached to the connector portion 22). The moveable component 12 is attached to the connector portion 22 by moving the lock and release mechanism 20 up to the attachment mechanism 29. For example, the lock tab 18 on the moveable component 12 is inserted into a hole in the inner tube 24 to connect the moveable component 12 with the connector portion 22.

The connector portion 22, in one embodiment, is preferably comprised of: an outer tube 26, which rotates around the handle 14, and is driven by the gear mechanisms of the present invention. As the outer tube 26 rotates around the handle 14, it drives the inner tube 24 around the handle 14. The inner tube 24 is connected to the moveable component 12 and drives the moveable component 12 around the handle 14 to wring the mop strands. In a preferred embodiment, the moveable component 12 rotates in a direction opposite to the rotation of the handle 14 (see FIG. 7). Accordingly, as the moveable component 12 and the handle rotate in opposite directions, the mop strands, which are attached to the end piece 10 of the handle 14 and the moveable component 12, are wrung around the handle 14. Accordingly, as the mop strands are wrung around the handle, the strands compress which causes the moveable component 12 and the attached inner tube 24 to be pulled along the handle 14 toward the mop end. As the inner tube 24 is pulled along the handle toward the mop end 10, the spring 28 is compressed (or pulled in an alternate embodiment) between the inner tube 24 and a spring resistance mechanism. 42. When the wringing process is complete, the mop strands are allowed to decompress and the spring 28 pushes the inner tube 24 back away from the mop end.

Gear-Driven Process

An important benefit of the present invention over known wringing mops is the incorporation of gears in driving the wringing process. By merely rotating the handle 14 in a predetermined direction, the mop strands can be tightly wrung with minimal effort and strain on the body. In the preferred embodiment, as the handle 14 is turned in one direction (either by manually turning the handle 14 or via an electric cordless handle driver), the second gear will drive the moveable component 12 in the opposite direction of the handle 14 causing the mop strands to wring around the handle 14. With the present invention, the user does not have to tightly grab and manually rotate the rotating portion connected to the mop simultaneously with the rotation of the handle 14 as with the known mops. With the present invention, the user only rotates the handle 14 and, through the use of driving gears, the moveable component 12 is automatically rotated around the handle 14 wringing the mop strands.

Figure 3A:
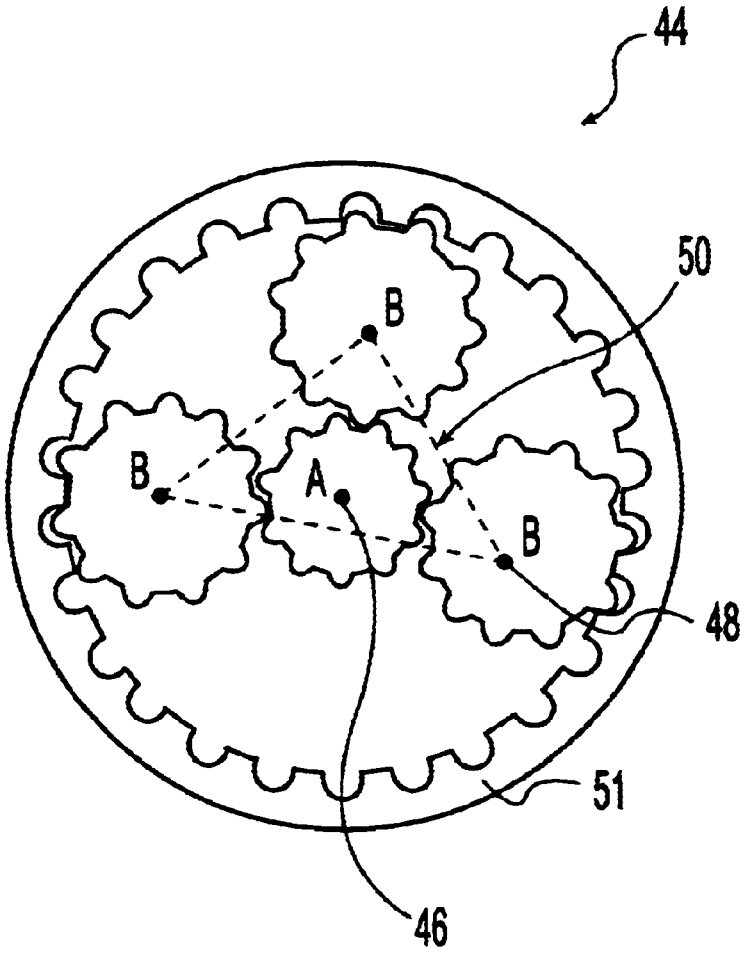
FIG. 3A illustrates one embodiment of a first gear configuration of the present invention.
Figure 3B:
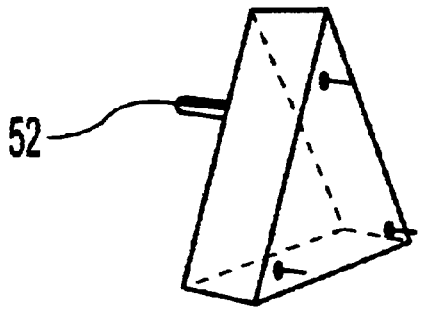
FIG. 3B illustrates a pinion gear.
Figure 4:
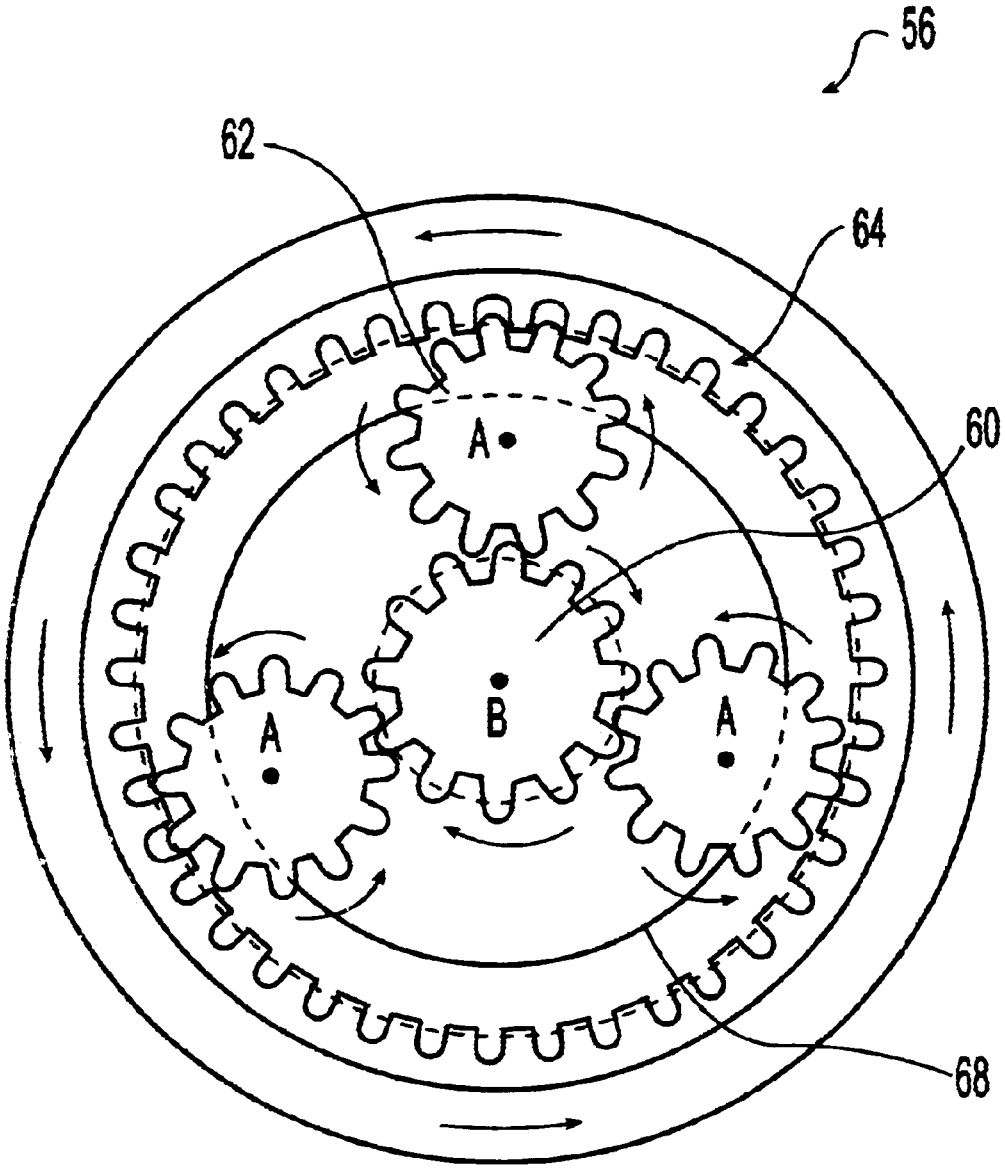
FIG. 4 illustrates one embodiment of a second gear configuration of the present invention.

FIGS. 3–5 more clearly depicts one embodiment of the gear configuration of the present invention. FIG. 3A illustrates a first gear configuration of the present invention; FIG. 3B illustrate a pinion gear; FIG. 4 illustrates a second gear configuration of the present invention.

In one embodiment, the first gear component 44 is preferably comprised of:

a drive gear 46 operationally linked to the handle 14 (in one embodiment a hexagon 47 may be mechanically interposed between the handle 14 and drive gear 46, the elongate hexagon 47 fitting into a corresponding hole in the drive gear 46 to drive the drive gear 46 as the handle 14 is turned);

a plurality of planetary orbit gears 48 driven by the drive gear 46;

a stationary plate 50 connected to the plurality of planetary orbit gears 48; and a first pinion gear 52 attached to, or built into, the stationary plate 50, wherein rotation of the drive gear 46 drives the pinion gear 52 (e.g., in the clockwise direction).

In one embodiment, as the handle 14 is rotated in the clockwise direction, the drive gear 46 is driven in the clockwise direction, the orbit gears 48 are driven in the clockwise direction, and the stationary plate 50 and pinion gear 52 are driven in the clockwise direction (in the preferred embodiment, the gearbox 51 is fixably mounted preventing rotation of the gearbox).

The rotation of the pinion gear 52 drives the second gear component 56. In one embodiment, the second gear component 56 is comprised of: a second pinion gear (or wire gear) 60 driven by the first pinion gear 52 (in one embodiment, the first pinion gear 52 is mechanically linked to the second pinion gear 60 by another elongate hexagon interposed between the two pinion gears 52, 60); an internal gear tube extension 64; a plurality of planetary orbit gears 62 driven in the counterclockwise direction (in one embodiment) by the second pinion gear 60 (the orbit gears 62 are mounted to the stationary plate 68 which does not rotate).

Figure 5A:
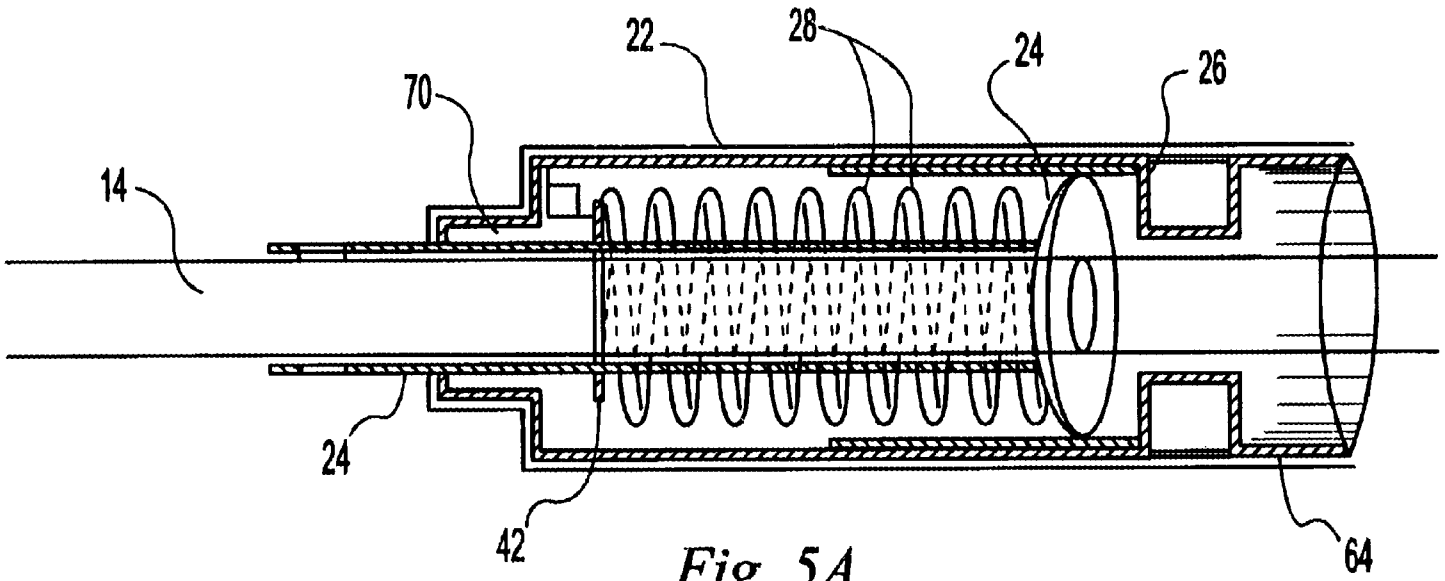
FIGS. 5A and 5B illustrate cross-sectional views of one embodiment of the inner and outer tubes of the present invention.

In one embodiment, as the second pinion gear 60 is driven in the clockwise direction by the first pinion gear 52, the planetary gears 62 rotate in the counterclockwise direction which drives the internal gear tube 64 in the counterclockwise direction. The internal gear tube 64 drives the outer tube 26 of the connector 22 (since it is an extension of the outer tube 26 in the described embodiment). FIGS. 5A and SB illustrate cross-sectional views of one embodiment of the inner and outer tubes of the connector 22 of the present invention.

Figure 5B:
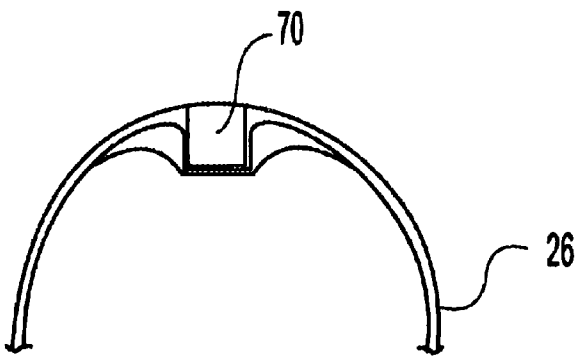

In one embodiment, as the second pinion gear 60 is driven in the clockwise direction by the first pinion gear 52, the planetary gears 62 rotate in the counterclockwise direction which drives the internal gear ring 64 in the counterclockwise direction. The internal gear tube 64 drives the outer tube 26 of the connector 22 (since it is an extension of the outer tube 26 in the described embodiment). FIGS. 5A and 5B illustrate crosssectional views of one embodiment of the inner and outer tubes of the connector 22 of the present invention.

The outer tube 26 rotates around the handle 14, wherein it drives the inner tube 24 around the handle 14. FIG. 5B shows a cross-sectional plan view of the outer tube 26 and inner tube 24. As the outer tube rotates 26, the longitudinal driver 70 drives the inner tube in the same direction. The inner tube 24 is connected to the moveable component 12 and drives the moveable component 12 around the handle 14 to wring the mop strands. In a preferred embodiment, the moveable component 12 rotates in a direction opposite to the rotation of the handle 14. Accordingly, as the moveable component 12 and the handle rotate in opposite directions, the mop strands, which are attached to the end piece 10 of the handle 14 and the moveable component 12, are wrung around the handle 14. Accordingly, as the mop strands are wrung around the handle, the strands compress which causes the moveable component 12 and the attached inner tube 24 to be pulled along the handle 14 toward the mop end. The handle 14 refers to the longitudinal component starting from the grip end to the mop end. The handle 14 may be one unitary piece or a plurality of components (e.g., in the described embodiment, the handle 14 is comprised of multiple portions connected via interposed components such as the hexagon 47 and gear components 44, 56). In one embodiment, body portion 45, along with the corresponding portion of the handle, can be left off the device.

As the inner tube 24 moves toward the mop end during the wringing process, a spring 28 operationally connected to the inner tube 24 is compressed (or pulled in another embodiment). When the wringing process is complete, the mop strands are allowed to unwind and the spring drives the inner tube 24 and moveable component 12 back away from the mop end.

Figure 7:
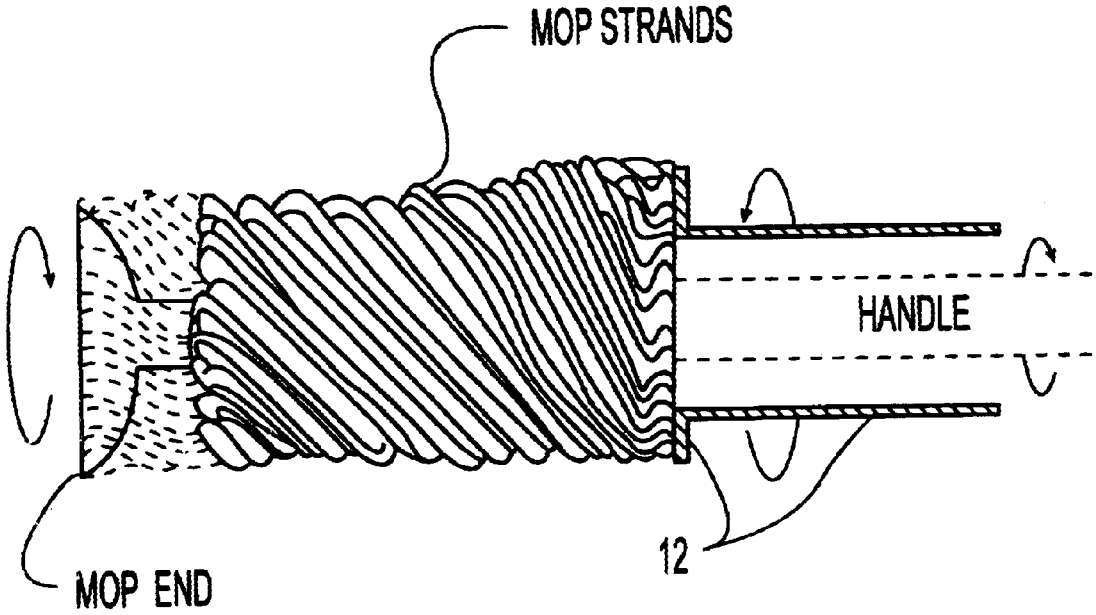
FIG. 7 illustrates one embodiment of the mop strands of a mop of the present invention in the wrung state.

FIG. 7 illustrates one embodiment of the mop end of the present invention in a fully wrung position. In one embodiment, the moveable component 12 moves in the counterclockwise direction (opposite of the mop end).

Figure 6A:
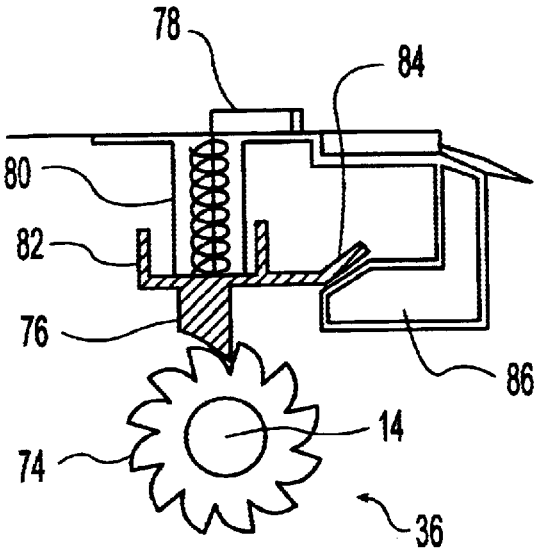
FIGS. 6A–6C illustrate one embodiment of the ratchet and pawl configuration of the present invention.
Figure 6B:
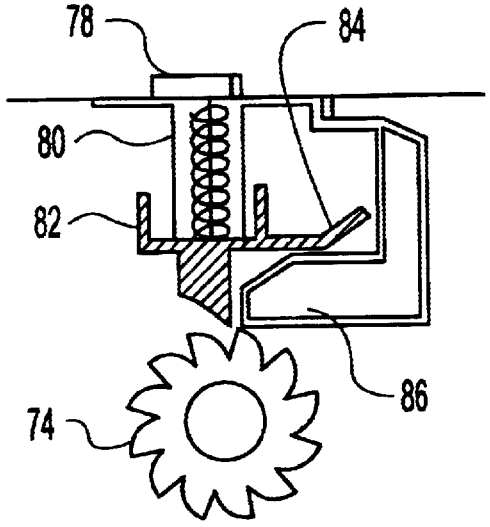
Figure 6C:
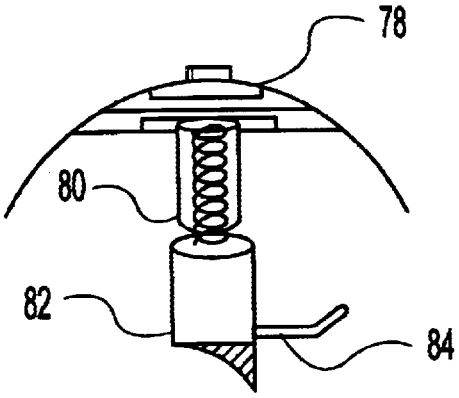

FIGS. 6A–6C illustrate one embodiment of the ratchet and pawl 36 configuration of the present invention. The ratchet 74 is preferably mounted to the handle 14, and the pawl 76 is housed in another portion of the body of the mop (e.g., connector 22). The pawl 76 engages the ratchet 74 during the wringing process to allow rotation.in only one direction (i.e., wringing direction). The actuation portion of the pawl 36 is further comprised of:

a.) an actuation plate 78;

b.) a spring housing 80;

c.) jaw portion 82 having an extension hook 84;

d.) a 90-degree angle hook 86.

In operation, when the actuation plate 78 is in a first position (see FIG. 6A), the jaw portion 82, under pressure from the spring in the spring housing 80, is in a down position; and the pawl 76 is engaged with the ratchet 74 allowing rotation in only one direction (e.g., during the wringing process). When the operator pushes the actuation plate 78 to a second position (e.g., forward) (see FIG. 6B), the 90-degree angle hook moves forward and moves the extension hook 84 (hook moves up), the jaw portion 82, and the pawl 76 up and off the ratchet 74 allowing rotation of the handle 14 and the mop strands in either rotational direction.

Having shown and described a preferred embodiment of the invention, those skilled in the art will realize that many variations and modifications may be made to affect the described invention and still be within the scope of the claimed invention. For example, the handle may be automatically rotated via a motor driven rotational means. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A wringing device for squeezing absorbed liquid from an attached cleaning attachment, comprising:

a handle grip;

a gear component operationally connected to said handle grip so that rotation of said handle grip drives said gear component;

an elongate member operationally connected to said gear component, wherein said gear component drives said elongate member in a predetermined rotational direction;

a moveable component operationally connected to said gear component, wherein said gear component drives said moveable component in a rotational direction opposite to said elongate member;

wherein rotation of said handle grip drives said gear component which drives rotation of said elongate member and moveable component in opposite directions to wring the attached cleaning attachment; and wherein said moveable component moves along a length of said elongate member as the attached cleaning attachment is wrung.

2. A wringing device according to claim 1, wherein said gear component is further comprised of:

a first gear operationally connected to said handle grip for driving said elongate member in a predetermined rotational direction;

a second gear mechanically connected to said first gear for driving said moveable component in a rotational direction opposite to said elongate member.

3. A wringing device according to claim 2, wherein said elongate member is a one-piece handle.

4. A wringing device according to claim 1, further comprising:

a second gear component operationally interposed between said handle grip and said gear component, wherein said second gear component drives said gear component when said handle grip is rotated.

5. A wringing device according to claim 1, wherein a portion of said cleaning attachment is attached to said moveable component so that when said moveable component rotates in a direction opposite to said elongate member, the cleaning attachment is wrung.

6. A wringing device according to claim 1, further comprising:

a spring operationally connected to said wringing device to provide a spring bias against said moveable component as said moveable component moves down the length of said elongate member.

7. A wringing device according to claim 1, wherein said handle grip is an automatic handle grip further comprised of:

a power source;

an actuation device; and wherein said gear component is automatically driven when said actuation device is activated.

8. A wringing device according to claim 1, wherein said handle grip is comprised of multiple elongate portions.

9. A wringing device according to claim 1, wherein said gear component is further comprised of:

a pinion gear operationally linked to said handle grip;

a plurality of planetary orbit gears driven by said pinion gear;

an internal gear tube driven in a rotational direction by said plurality of planetary orbit gears in said gear component.

10. A wringing device according to claim 1, further comprising:

a ratchet connected to said elongate member;

a pawl movable from a first position to a second position, said pawl engaging said ratchet in the first position for preventing said ratchet and said elongate member from rotating in a predetermined direction, said ratchet and said elongate member freely moveable in both directions when said pawl is in the second position disengaged from said ratchet, said pawl adapted to be engaged to said ratchet during the wringing process to prevent the cleaning attachment from unwinding during the wringing process.

11. A wringing device according to claim 10, further comprising:

an actuation means adapted to move from a first position to a second position;

a disengagement means connected to said pawl and said actuation means for disengaging said pawl from said ratchet when moved from a first position to a second position.

12. A device according to claim 11, wherein said actuation means is a sliding plate, and wherein a compression spring is engaged to one end of said pawl for pushing said pawl against said ratchet in an engage mode.

13. A wringing device for squeezing absorbed liquid from an attached cleaning attachment, comprising:

a gear component;

an elongate member operationally connected to said gear component, wherein said gear component drives said elongate member in a predetermined rotational direction;

a moveable component operationally connected to said gear component, wherein said gear component drives said moveable component in a rotational direction opposite to said elongate member;

wherein said actuation of said gear component drives the rotation of said elongate member and moveable component in opposite directions to wring the attached cleaning attachment;

wherein said gear component is further comprised of a first gear component which drives said elongate member in a predetermined direction while driving a second gear component which drives said moveable component in a rotational direction opposite to said elongate member and where in the interaction of the first and second gear components provide enhanced torque in wringing the attached cleaning attachments;

a retaining device attached to a distal end of said elongate member, wherein a distal end of the cleaning attachment is attached to said retaining device, and wherein a proximal end of the cleaning attachment is attached to said moveable component, and wherein wringing of the cleaning attachment by rotation of said elongate member in one direction and the moveable component in the other direction causes the compression of the cleaning attachment and movement of said moveable component toward said distal end of said elongate member during the wringing process; and a spring operationally connected to said wringing device to provide a spring bias against said moveable component as said moveable component moves down the length of said elongate member.

14. A wringing device for squeezing absorbed liquid from an attached cleaning attachment, comprising:

handle grip;

a gear component operationally connected to said handle grip so that rotation of said handle grip drives said gear component;

an elongate member operationally connected to said gear component, wherein said gear component drives said elongate member in a predetermined rotational direction;

a moveable component operationally connected to said gear component, wherein said gear component drives said moveable component in a rotational direction opposite to said elongate member;

wherein rotation of said handle grip drives said gear component which drives rotation of said elongate member and moveable component in opposite directions to wring the attached cleaning attachment; and wherein said moveable component moves along a length of said elongate member and wherein a portion of the cleaning attachment is attached to an end of said elongate member.

15. A wringing device for squeezing absorbed liquid from an attached cleaning attachment, comprising:

a handle grip;

a gear component operationally connected to said handle grip so that rotation of said handle grip drives said gear component;

an elongate member operationally connected to said gear component, wherein said gear component drives said elongate member in a predetermined rotational direction;

a moveable component operationally connected to said gear component, wherein said gear component drives said moveable component in a rotational direction opposite to said elongate member;

wherein rotation of said handle grip drives said gear component which drives rotation of said elongate member and moveable component in opposite directions to wring the attached cleaning attachment; and a connector mechanically linked between said moveable component and said gear component, said connector driven by said gear component so as to rotate, wherein said connector is adapted to attach to said moveable component when in the wringing position, and wherein the rotational movement of said connector drives said moveable component in a predetermined rotational direction around said elongate member.

16. A wringing device according to claim 15, wherein said connector is further comprised of:

a first section rotatably moveable around said elongate member and driven by said gear component;

a second section operationally linked to said first section and rotatably moveable around said elongate member, and wherein said second section is adapted for moving longitudinally along said elongate member when driven by said rotating first section, wherein a distal end of said second section is adapted to be connected to said moveable component so as to rotatably drive said moveable component during the wringing process; and a spring operationally connected to said second section of said connector, wherein said spring is compressed when said second section of said connector moves down the length of said elongate member during the wringing process.

17. A wringing device according to claim 16, further comprising:

a retaining device attached to a distal end of said elongate handle, wherein a distal end of the cleaning attachment is attached to said retaining device, and wherein a proximal end of the cleaning attachment is attached to said moveable component, and wherein wringing of the cleaning attachment by rotation of said elongate member in one direction and the moveable component in the other direction causes the compression of the cleaning attachment and movement of said moveable component toward said distal end of said elongate member during the wringing process which causes compression of said spring.

* * * * *

UNITED STATES PATENT AND TRADEMARK OFFICE

CERTIFICATE OF CORRECTION

PATENT NO. : 6,615,437 B1
DATED : September 9, 2003
INVENTOR(S) : Sik Cheung Chow It is certified that error appears in the above-identified patent and that said Letters Patent is hereby corrected as shown below:

Column 4,
Lines 51-60, please delete "In one embodiment, as the second pinion gear 60 is driven in the clockwise direction by the first pinion gear 52, the planetary gears 62 rotate in the counterclockwise direction which drives the internal gear tube 64 in the counterclockwise direction. The internal gear tube 64 drives the outer tube 26 of the connector 22 (since it is an extension of the outer tube 26 in the described embodiment). FIGS 5A and SB illustrate cross-sectional views of one embodiment of the inner and outer tubes of the connector 22 of the present invention." and insert -- In one embodiment, the internal gear tube 64 is a portion of the outer tube 26 (an extension of it). See FIG 5A. The internal gear tube 64 is driven in the counterclockwise direction by the plurality of planetary orbit gears 62. --

Signed and Sealed this

Twenty-seventh Day of January, 2004

JON W. DUDAS
*Acting Director of the United States Patent and Trademark Office*